US008596236B2

(12) United States Patent
Chung et al.

(10) Patent No.: US 8,596,236 B2
(45) Date of Patent: Dec. 3, 2013

(54) VARIABLE VALVE DRIVING APPARATUS

(75) Inventors: Young Chong Chung, Yongin-si (KR); Tae Hoon Roh, Seoul (KR)

(73) Assignee: Hyundai Motor Company, Seoul (KR)

( * ) Notice: Subject to any disclaimer, the term of this patent is extended or adjusted under 35 U.S.C. 154(b) by 272 days.

(21) Appl. No.: 13/167,273

(22) Filed: Jun. 23, 2011

(65) Prior Publication Data

US 2012/0137999 A1 Jun. 7, 2012

(30) Foreign Application Priority Data

Dec. 6, 2010 (KR) ..... 10-2010-0123463

(51) Int. Cl.
*F01L 1/34* (2006.01)

(52) U.S. Cl.
USPC ..... 123/90.17; 123/90.16; 464/160

(58) Field of Classification Search
USPC ..... 123/90.17, 90.6, 90.16; 464/1, 2, 160
See application file for complete search history.

(56) References Cited

U.S. PATENT DOCUMENTS 3,516,394 A * 6/1970 Nichols Roy G ..... 123/90.17
4,517,934 A * 5/1985 Papez ..... 123/90.17

FOREIGN PATENT DOCUMENTS

| | | | |
|---|---|---|---|
| JP | 7-324610 | A | 12/1995 |
| JP | 2001-234722 | A | 8/2001 |
| KR | 2003-0039131 | A | 5/2003 |
| KR | 10-2006-0004236 | A | 1/2006 |
| KR | 10-2007-0062793 | A | 6/2007 |

* cited by examiner

*Primary Examiner* — Ching Chang
(74) *Attorney, Agent, or Firm* — Morgan, Lewis & Bockius LLP

(57) ABSTRACT

A variable valve driving apparatus includes a driving shaft including a first camshaft and a second camshaft coaxially disposed to the first camshaft, a driving cam including an opening cam disposed to the first camshaft and a closing cam disposed to the second camshaft, a phase control portion controlling relative phases between the first camshaft and the second camshaft and a valve opening portion opened by the opening cam and the closing cam.

5 Claims, 5 Drawing Sheets

(a)

(b)

VARIABLE VALVE DRIVING APPARATUS

CROSS-REFERENCE TO RELATED APPLICATION

The present application claims priority of Korean Patent Application Number 10-2010-0123463 filed Dec. 6, 2010, the entire contents of which application is incorporated herein for all purposes by this reference.

BACKGROUND OF INVENTION

1. Field of Invention

The present invention relates to a variable valve driving apparatus. More particularly, the present invention relates to a variable valve driving apparatus that can adjust a valve opening amount in response to an operational state of an engine.

2. Description of Related Art

Generally, an automotive engine includes a combustion chamber in which fuel burns to generate power. The combustion chamber is provided with an intake valve for supplying a gas mixture containing the fuel and an exhaust valve for expelling the burned gas. The intake and exhaust valves open and close the combustion chamber by a valve lift apparatus connected to a crankshaft.

A conventional valve lift apparatus has a fixed valve lift amount using a cam formed in a predetermined shape. Therefore, it is impossible to adjust the amount of a gas mixture that is being introduced or exhausted. Therefore, the engine does not run at its optimal efficiency in various driving ranges.

For example, as a conventional art, if a valve lift apparatus is designed to optimally respond to a low driving speed, the valve open time and amount are not sufficient for a high speed driving state. On the contrary, when the valve lift apparatus is designed to optimally respond to a high speed driving state, an opposite phenomenon occurs in the low speed driving state.

The above information disclosed in this Background section is only for enhancement of understanding of the background of the invention and therefore it may contain information that does not form the prior art that is already known in this country to a person of ordinary skill in the art.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention provide for a variable valve driving apparatus having advantages of adjusting a valve opening amount in response to an operational state of an engine.

On aspect of the present invention is directed to a variable valve driving apparatus that may include a driving shaft including a first camshaft and a second camshaft coaxially disposed to the first camshaft, a driving cam including an opening cam disposed to the first camshaft and a closing cam disposed to the second camshaft, a phase control portion controlling relative phases between the first camshaft and the second camshaft and a valve opening portion opened by the opening cam and the closing cam.

The valve opening portion may include a cam follower, a cam follower roller disposed to the cam follower and receiving rotation of the driving cam and a valve disposed to an end of the cam follower.

The variable valve driving apparatus may further include a switch portion which temporarily supports the end of the cam follower for the valve not to be temporarily closed.

The switch portion may include a switch cam which is connected to the second shaft and rotates, a switch shaft which is parallel to the driving shaft and a switch lever which is pivotally disposed to the switch shaft and selectively supports the end of the cam follower according to rotation of the switch cam.

The switch lever may include a switch lever roller contacting the switch cam and a support portion selectively supporting the end of the cam follower.

Another aspect is directed to a switch portion of a variable valve driving apparatus that may include a support pin which selectively supports the end of the cam follower and an electric control portion controlling position of the support pin.

The switch portion of the variable valve driving apparatus according to various aspects of the present invention may include a support pin which selectively supports the end of the cam follower and a hydraulic pressure control portion controlling position of the support pin.

The variable valve driving apparatus according to various aspects of the present invention may adjust a valve opening amount in response to an operational state of an engine with simple scheme.

Manufacturing cost may be reduced with simple elements and engine efficiency may be enhanced with relatively low dynamic load.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
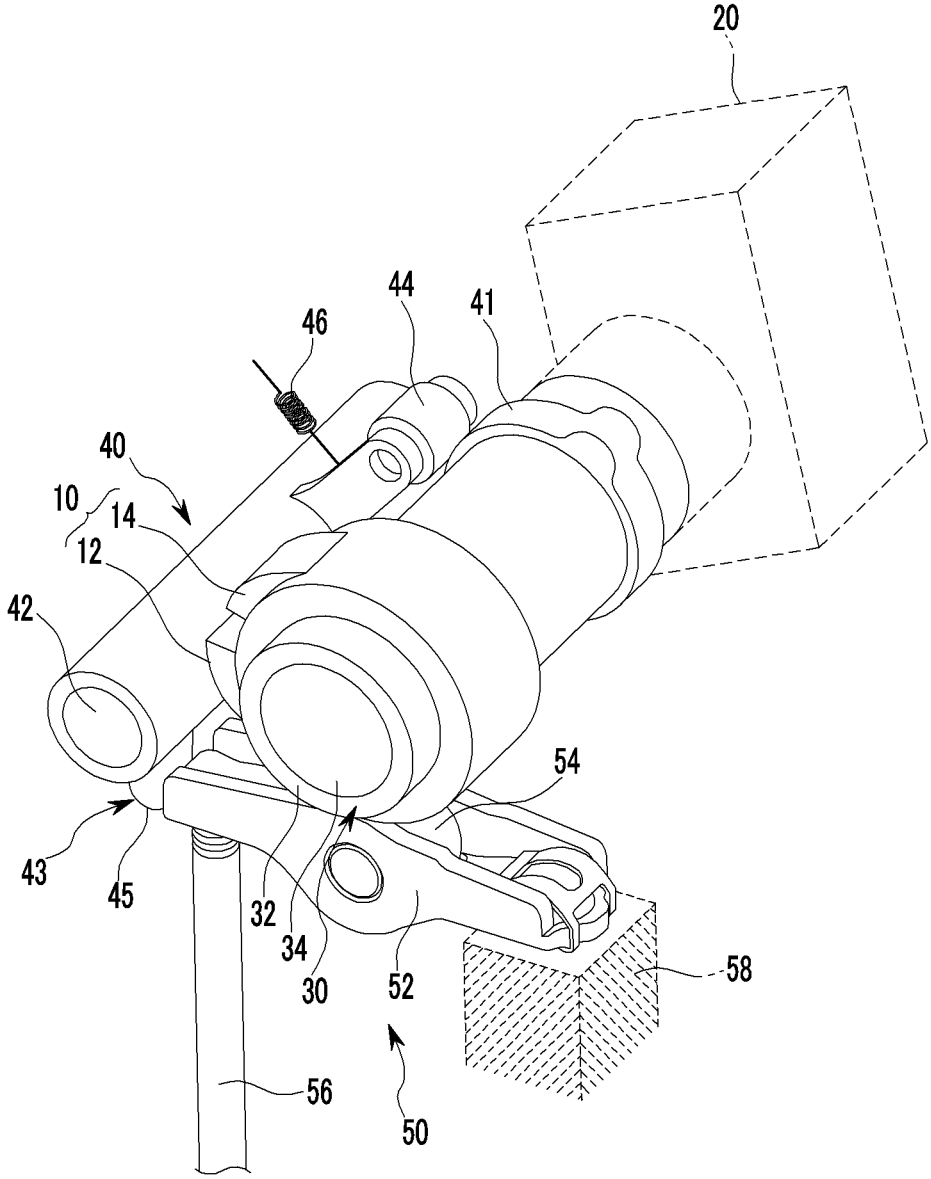
FIG. 1 is a perspective view of an exemplary variable valve driving apparatus according the present invention.
Figure 2:
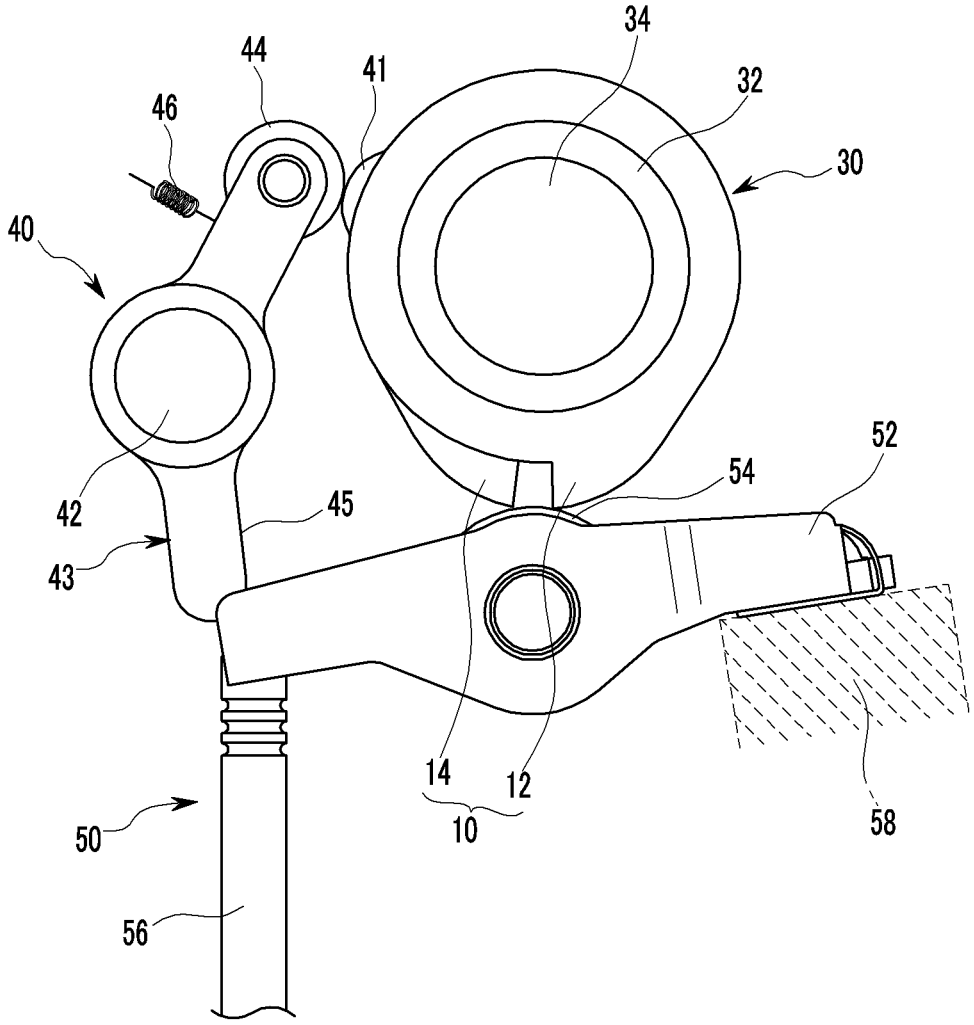
FIG. 2 and FIG. 3 are front views of the exemplary variable valve driving apparatus of FIG. 1 in high opening mode.
Figure 3:
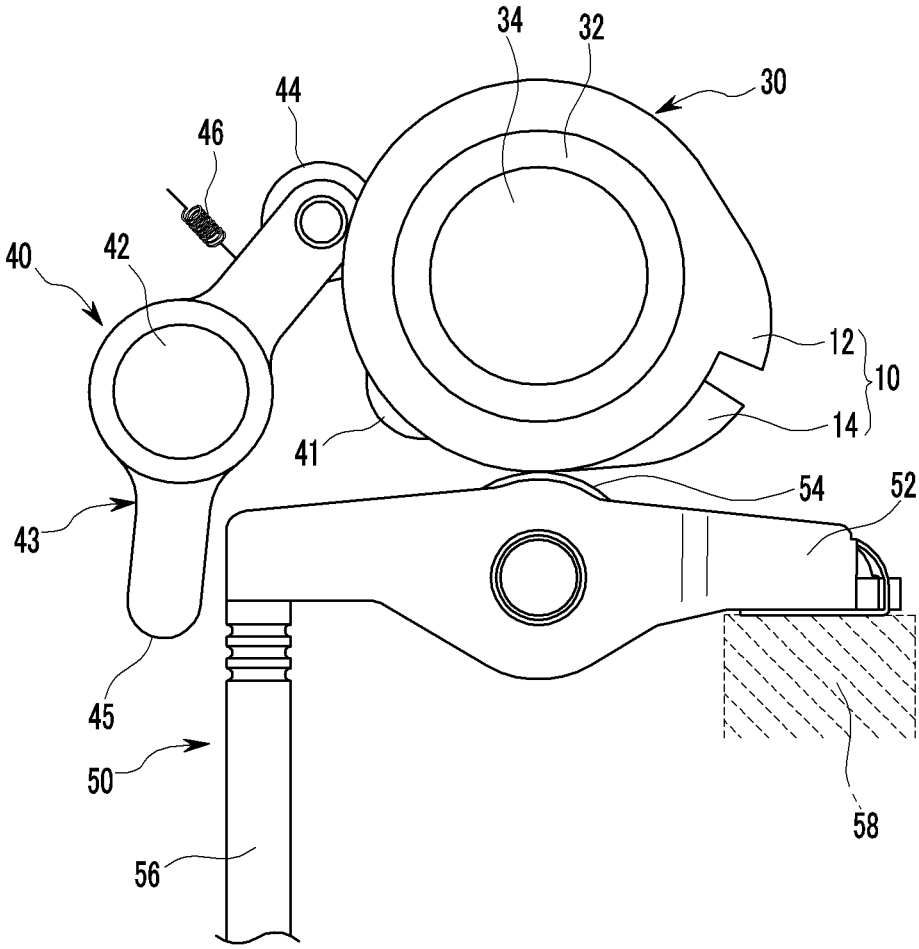

FIG. 1 is a perspective view of a variable valve driving apparatus according to various embodiments of the present invention, and FIG. 2 and FIG. 3 are front views of a variable valve driving apparatus according to various embodiments of the present invention in high opening mode.

Referring to FIG. 1 to FIG. 3, a variable valve driving apparatus according to various embodiments of the present invention includes a driving shaft 30 including a first camshaft 32 and a second camshaft 34 coaxially disposed to the first camshaft 32, a driving cam 10 including an opening cam 12 disposed to the first camshaft 32 and a closing cam 14 disposed to the second camshaft 34, a phase control portion 20 controlling relative phases between the first camshaft 32 and the second camshaft 34 and a valve opening portion 50 opened by the opening cam 12 and the closing cam 14.

The first camshaft 32 and the second camshaft 34 are disposed that relative phases between the first camshaft 32 and the second camshaft 34 to be adjusted. In the drawing the second camshaft 34 is disposed within the first camshaft 32, however it is not limited to the description of the drawing, on the contrary the opposite arrangement also possible.

The valve opening portion 50 includes a cam follower 52, a cam follower roller 54 disposed to the cam follower 52 and receiving rotation of the driving cam 10 and a valve 56 disposed to an end of the cam follower 52.

The other end of the cam follower 52 is supported by an engine 58 and in this case, the engine 58 may be interpreted to include a hydraulic pressure lash adjuster, a cylinder head, a valve train and so on.

The variable valve driving apparatus further includes a switch portion 40 which temporarily supports the end of the cam follower 52 for the valve 56 not to be temporarily closed.

The switch portion 40 includes a switch cam 41 which is connected to the second shaft 34 and rotates, a switch shaft 42 which is parallel to the driving shaft 30 and a switch lever 43 which is pivotally disposed to the switch shaft 42 and selectively supports the end of the cam follower 52 according to rotation of the switch cam 41.

The switch lever 43 includes a switch lever roller 44 contacting the switch cam 41 and a support portion 45 selectively supporting the end of the cam follower 52.

If the relative phase between the second shaft 34 and the first shaft 32 is changed, relative phase of the opening cam 12 to the closing cam 14 and the switch cam 41 which is connected to the second shaft 34 to rotate also changed.

Figure 4:
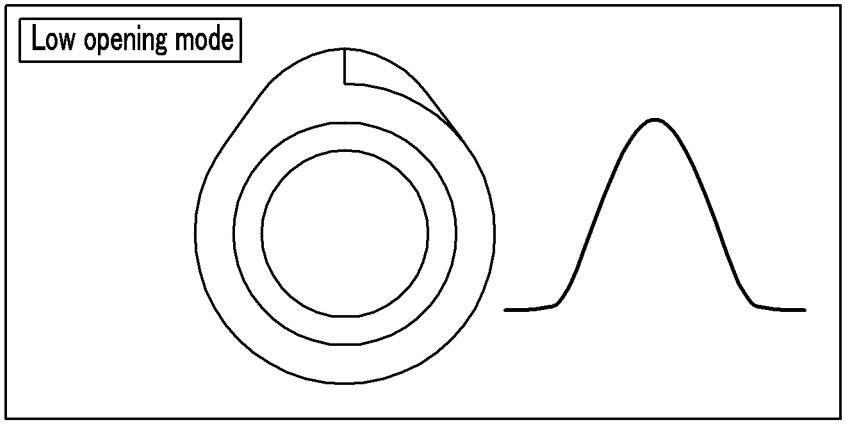
FIG. 4 is a drawing showing operations of high opening mode and low opening mode of the variable valve driving apparatus of FIG. 1.
Figure 4:
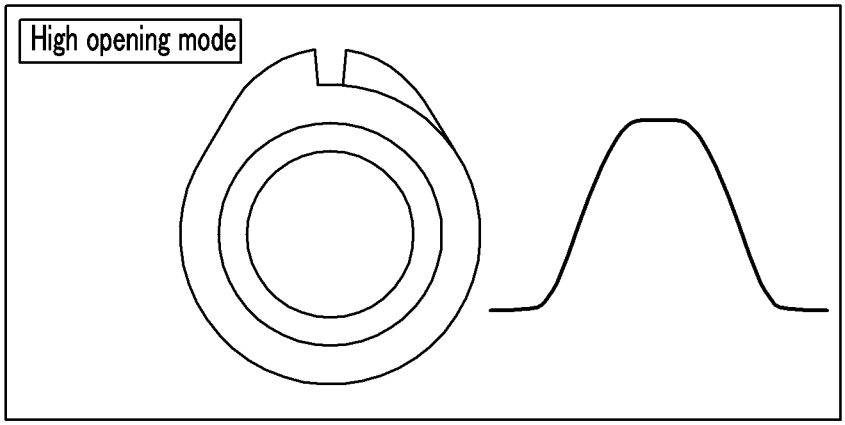

FIG. 4 is a drawing showing operations of high opening mode and low opening mode of a variable valve driving apparatus according various embodiments of the present invention.

Referring to FIG. 1 to FIG. 4, operation of the variable valve driving apparatus according to various embodiments of the present invention will be described.

In high opening mode, an ECU (engine control unit; not shown) controls the phase control portion 20 to adjust relative phase between the second shaft 34 and the first shaft 32.

And then, as shown in FIG. 1 to FIG. 3, relative positions between the opening cam 12 and the closing cam 14 are changed and thus duration of opening of the valve 56 is increased.

When the cam follower roller 54 is positioned between the opening cam 12 and the closing cam 14, the switch cam 41 contacts the switch lever roller 44 and the switch lever 43 rotates around the switch shaft 42.

And thus, the support portion 45 pushes the end of the cam follower 52 so that closing of the valve 56 is temporarily suspended.

And then, when the cam follower roller 54 contacts the closing cam 14, the support portion 45 is separated from the cam follower 52 by elastic force of the spring 46 and then the valve 56 is closed.

That is, as shown (b) of FIG. 4, duration of opening of the valve 56 is increased in the high opening mode.

Operations and constructions of the ECU or the phase control portion 20 are obvious to a person skilled in the art so that detailed description will be omitted.

In low opening mode, the ECU controls the phase control portion 20 to change relative phase of the second shaft 34 and the first shaft 32 to opposite direction.

And thus, relative positions between the opening cam 12 and the closing cam 14 are closed as shown (a) of FIG. 4.

Relative position of the switch cam 41 is changed together with the closing cam 14 and in the low opening mode the support portion 45 does not disrupt closing of the valve 56.

That is, in the low opening mode, as shown in (a) of FIG. 4, variable valve driving apparatus realizes general valve lift profile.

Figure 5:
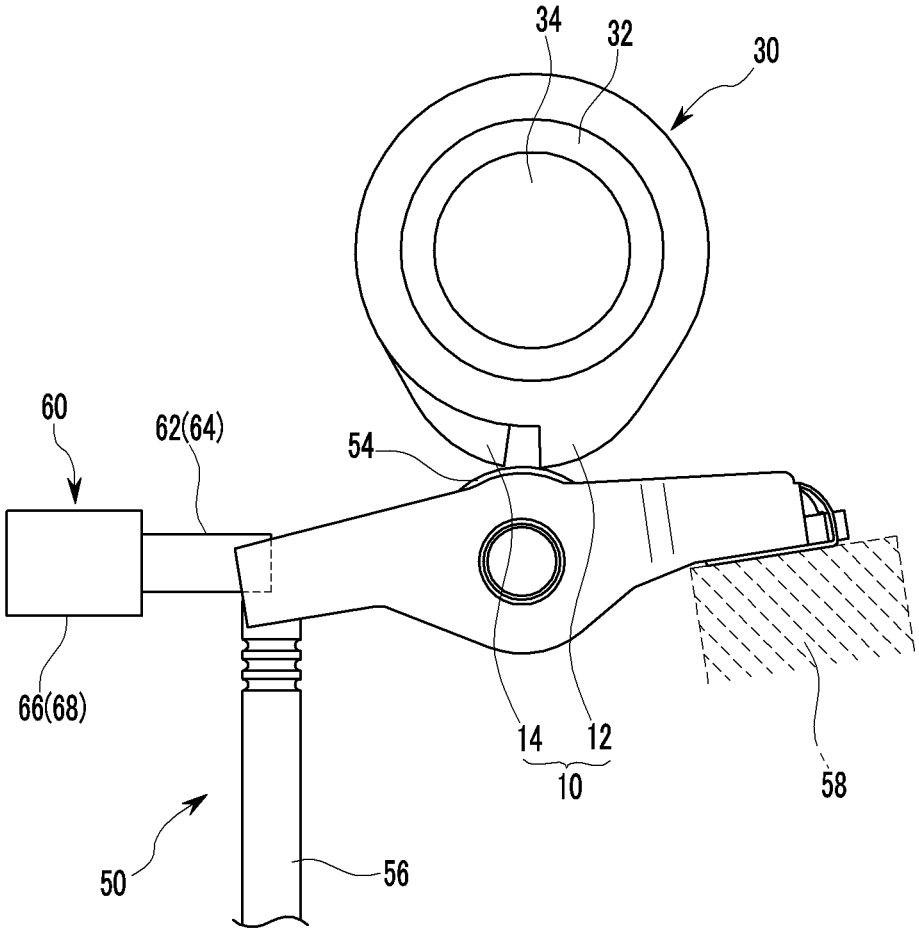
FIG. 5 is a front view of another exemplary variable valve driving apparatus according the present invention.

FIG. 5 is a front view of a variable valve driving apparatus according to various embodiments of the present invention.

Operations and constructions of the variable valve driving apparatus according to various embodiments of the present invention is identical to the variable valve driving apparatus according to the above-described embodiments of the present invention except for constructions and operations of the switch portion and thus repeated description will be omitted.

For better comprehension and ease of description, in FIG. 5, the same elements of the variable valve driving apparatus to the first exemplary above-described embodiments of the present invention will be denoted as the same reference numbers.

In various embodiments of the present invention the switch portion 60 includes a support pin 62 or 64 which selectively supports the end of the cam follower 52 and an electric control portion 66 or hydraulic pressure control portion 68 which controls position of the support pin 62 or 64.

The electric control portion 66 or the hydraulic pressure control portion 68, in high opening mode, temporarily pushes the end of the cam follower 52 using the support pin 62 or 64 so as to temporarily suspend closing of the valve 56 by controlling of an ECU during the cam follower roller 54 is disposed between the opening cam 12 and the closing cam 14.

Operations and constructions of the electric control portion 66 or the hydraulic pressure control portion 68 are otherwise known with reference to the above detailed description so that a detailed description of the electric control portion 66 or the hydraulic pressure control portion 68 will be omitted.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable valve driving apparatus comprising:

a driving shaft including a first camshaft and a second camshaft coaxially disposed with respect to the first camshaft;

a driving cam including an opening cam disposed against the first camshaft and a closing cam disposed against the second camshaft;

a phase control portion controlling relative phases between the first camshaft and the second camshaft;

a valve opening portion opened by the opening cam and the closing cam, wherein the valve opening portion comprises:

a cam follower;

a cam follower roller disposed to the cam follower and receiving rotation of the driving cam; and a valve disposed to an end of the cam follower; and a switch portion which temporarily supports the end of the cam follower for the valve not to be temporarily closed.

2. The variable valve driving apparatus of claim 1, wherein the switch portion comprises:

a switch cam which is connected to the second shaft and rotates;

a switch shaft which is parallel to the driving shaft; and a switch lever which is pivotally disposed against the switch shaft and selectively supports the end of the cam follower according to rotation of the switch cam.

3. The variable valve driving apparatus of claim 2, wherein the switch lever comprises:

a switch lever roller contacting the switch cam; and a support portion selectively supporting the end of the cam follower.

4. The variable valve driving apparatus of claim 1, wherein the switch portion comprises:

a support pin which selectively supports the end of the cam follower; and an electric control portion controlling position of the support pin.

5. The variable valve driving apparatus of claim 1, wherein the switch portion comprises:

a support pin which selectively supports the end of the cam follower; and a hydraulic pressure control portion controlling position of the support pin.

* * * * *